US010662705B2

(12) United States Patent
Hall et al.

(10) Patent No.: US 10,662,705 B2
(45) Date of Patent: May 26, 2020

(54) TRACK SYSTEM FOR RETRACTABLE WALL

(71) Applicants: David R. Hall, Provo, UT (US); Joe Fox, Spanish Fork, UT (US); Andrew Priddis, Mapleton, UT (US); Jackson Priddis, Orem, UT (US)

(72) Inventors: David R. Hall, Provo, UT (US); Joe Fox, Spanish Fork, UT (US); Andrew Priddis, Mapleton, UT (US); Jackson Priddis, Orem, UT (US)

(73) Assignee: Hall Labs LLC, Provo, UT (US)

( * ) Notice: Subject to any disclaimer, the term of this patent is extended or adjusted under 35 U.S.C. 154(b) by 113 days.

(21) Appl. No.: 15/488,115

(22) Filed: Apr. 14, 2017

(65) Prior Publication Data

US 2018/0298687 A1 Oct. 18, 2018

(51) Int. Cl.

| | |
|---|---|
| ***E06B 9/58*** | (2006.01) |
| ***E04B 2/74*** | (2006.01) |
| ***E06B 9/13*** | (2006.01) |
| *E06B 9/17* | (2006.01) |

(52) U.S. Cl.

CPC ..... *E06B 9/581* (2013.01); *E04B 2/7453* (2013.01); *E06B 9/13* (2013.01); *E06B 9/582* (2013.01); *E04B 2002/7479* (2013.01); *E06B 2009/17069* (2013.01); *E06B 2009/585* (2013.01); *E06B 2009/588* (2013.01)

(58) Field of Classification Search

CPC ..... E06B 9/581; E06B 9/58; E06B 2009/585; E06B 2009/588; E06B 2009/17069; E06B 9/13; E06B 9/44; E06B 9/46; E06B 2009/587; E06B 9/56; E04B 2002/7479; E04B 2/7453

See application file for complete search history.

(56) References Cited

U.S. PATENT DOCUMENTS

| | | | | |
|---|---|---|---|---|
| 6,512,673 | B1 * | 1/2003 | Wiley | G06F 1/183 165/185 |
| 2012/0012260 | A1 * | 1/2012 | Elinson | E06B 9/42 160/240 |
| 2012/0255687 | A1 * | 10/2012 | Komatsu | E06B 9/13 160/310 |

(Continued)

OTHER PUBLICATIONS

Soltis Master 99 and BV 99, accessed Oct. 31, 2018 from https://www.sergeferrari.com/us-en/products/soltis-range/soltis-master-99-and-bv-99#f_technical_specifications.*

*Primary Examiner* — Katherine W Mitchell
*Assistant Examiner* — Jeremy C Ramsey

(57) ABSTRACT

The invention is a track system for a retractable wall. The track system includes rigid outer guide tracks and flexible inner track inserts that are connected to the guide tracks by means of flanges located on both. The flexible inserts include a channel that engages with a side edge of a retractable wall, holding the wall in place. The flexible nature of the track inserts allows the inserts to bend, which in turn allows the retractable wall to flex when force is exerted on the retractable wall without breaking the tracks or tearing the wall. When excessive force is applied, the channel of the flexible insert, the walls of which are thicker than the rest of the flexible insert, bend open, so that the side edge of the retractable wall disengages from the channel by means of an opening in the channel.

14 Claims, 10 Drawing Sheets

(56) References Cited

U.S. PATENT DOCUMENTS

| | | | | |
|---|---|---|---|---|
| 2015/0345215 | A1* | 12/2015 | Roberts | E06B 9/42 160/368.1 |
| 2016/0348424 | A1* | 12/2016 | Lorenzani | E06B 9/13 |
| 2017/0009524 | A1* | 1/2017 | Dwarka | E06B 9/24 |
| 2017/0044826 | A1* | 2/2017 | Nakae | E06B 9/42 |

* cited by examiner

TRACK SYSTEM FOR RETRACTABLE WALL

CROSS-REFERENCES

Technical Field

This invention relates generally to the field of retractable walls, and more specifically to tracks for retractable walls.

BACKGROUND

Adaptability is a desirable feature in some building designs, especially where space is constrained or quick or frequent adjustments are needed. While home or office furnishings are easily manipulated, building structures are more difficult to change. However, one method that has been successfully used to accomplish this purpose is a retractable, or roll-up, wall. Retractable walls can fill purposes such as allowing room sizes to be quickly adjusted.

A typical retractable wall includes one or more sheets of flexible material that are wound about a roller device of some sort, usually displaced above an entryway such that the material can be deployed downward over the entryway on demand, creating an impassible barrier. Most retractable wall systems also include a guide track system on either side of the wall that secures the retractable wall in place as it rises and lowers. A typical guide track system involves a device with a channel into which an edge of the retractable wall is inserted. Often, the edge of the retractable wall will have a zippered edge, to hold the edge in place within the channel.

The benefits gained through the flexibility of the retractable wall also come with a significant disadvantage, however. Although the wall material can flex to hold some amount of force exerted on the wall, in the event that a great deal of force is exerted on the flexible wall material, the wall material may tear, causing expensive damage to the system. This problem can be solved if the guide track system allows the wall to disengage from the channel before the wall tears. Unfortunately, the few guide track systems that currently allow the wall to disengage from the guide track system when excessive force is applied are unnecessarily complex or rigid. For example, one system has a complex spring system that helps the wall to flex.

In light of the foregoing, what is needed is a simple guide track system that allows the retractable wall to disengage from the system when excessive force is applied. The guide track system should be flexible, easily constructed, and aesthetically pleasing.

SUMMARY OF THE INVENTION

The disclosed invention has been developed in response to the present state of the art and, in particular, in response to the problems and needs in the art that have not yet been fully solved by currently available components and methods. Accordingly, efficient structural components and methods have been developed to allow for a simple guide track system that allows a retractable wall to disengage from the system when excessive force is applied to the wall.

Consistent with the foregoing, a track system for a retractable wall is disclosed. The track system comprises a plurality of guide tracks comprising reentrant flanges. The plurality of guide tracks are mounted to remote side surfaces that define a plane of operation for a retractable wall that moves between open and closed positions. The track system also comprises a plurality of flexible inserts removably displaced within the plurality of guide tracks. Each flexible insert comprises side walls that comprise side wall flanges. The side wall flanges engage with the reentrant flanges of the plurality of guide tracks to connect the plurality of flexible inserts to the plurality of guide tracks. Each flexible insert further comprises a back wall that comprises a channel. The channel comprises an opening. A side edge of the retractable wall engages and travels along the channel as it moves between the open and closed positions.

In one embodiment, the plurality of guide tracks comprise a rigid material, such as metal. In one embodiment, the plurality of flexible inserts comprise plastic. In one embodiment, the retractable wall comprises a sound-attenuating material, such as mass-loaded vinyl (MLV). The side edges of the retractable wall may comprise PVC cords, such as Keder cords. In one embodiment, the remote side surfaces may be walls of a building.

In one embodiment, the channel of each flexible insert is an annular channel. In one embodiment, the side edge of the retractable wall has a diameter that is larger, preferably three to seven times larger, than the opening in the channel, so that the side edge of the retractable wall is held fast within the channel. In one embodiment, walls of the channel are thicker than the back wall of each flexible insert, so that the back wall bends more easily. In one embodiment, the back wall flexes when a tensile force is exerted on the retractable wall. In one embodiment, the side edge of the retractable wall disengages from the channel by means of the opening when an excessive force is exerted on the retractable wall. In one embodiment, the back wall of each flexible insert is bowed to leave space between the back wall and the guide track for fasteners that are used to mount the guide track to the remote side surfaces. In one embodiment, each flexible insert comprises one or more sealing members that provide soundproofing and protection from debris.

BRIEF DESCRIPTION OF THE DRAWINGS

A more particular description of the invention briefly described above is made below by reference to specific embodiments depicted in drawings included with this application, in which.

DETAILED DESCRIPTION

A detailed description of the claimed invention is provided below by example, with reference to embodiments in the appended figures. Those of skill in the art will recognize that the components of the invention as described by example in the figures below could be arranged and designed in a wide variety of different configurations. Thus, the detailed description of the embodiments in the figures is merely representative of embodiments of the invention, and is not intended to limit the scope of the invention as claimed.

Figure 1:
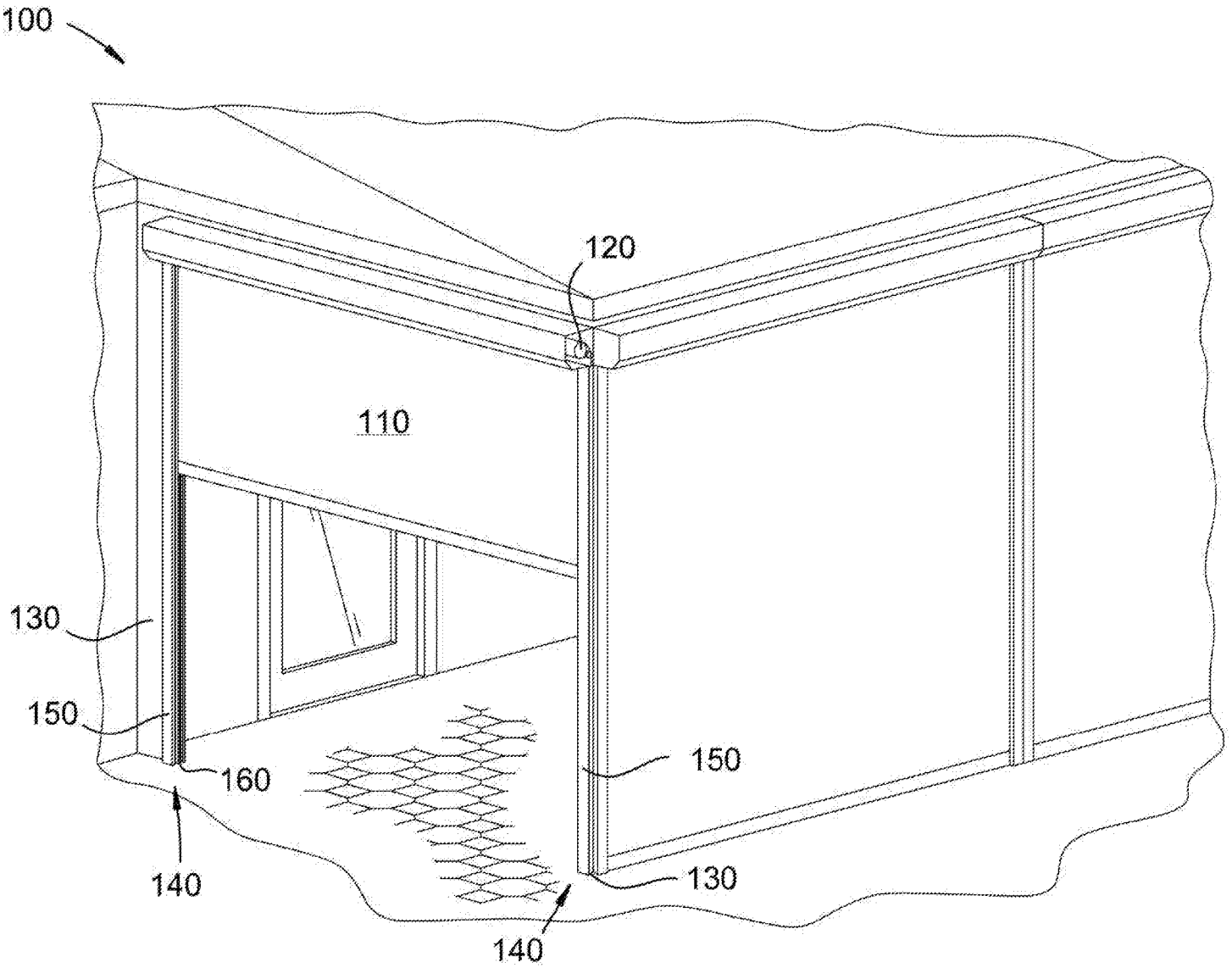
FIG. 1 depicts one embodiment of a retractable wall system.

FIG. 1 depicts one embodiment of a retractable wall system 100. In one embodiment, the retractable wall system 100 comprises a retractable wall 110 wound around a motorized drum 120. In one embodiment, the motorized drum 120 is positioned at an uppermost position between remote side surfaces 130 that define a plane of operation for the retractable wall 110, and the retractable wall 110 moves up and down between open and closed positions in the plane of operation by means of the motorized drum 120. The retractable wall 110 is held in place and guided in its path by means of the invented track system 140, which comprises a plurality of guide tracks 150 mounted to the remote side surfaces 130 and a plurality of flexible inserts 160 removably displaced within the plurality of guide tracks 150. The retractable wall system 100 may form the wall of a building, such as a house, wherein the remote side surfaces 130 are adjoining walls of the building. The retractable wall system 100 may form the wall of a patio, wherein the remote side surfaces 130 are posts or poles. In other embodiments, the remote side surfaces 130 may be other fixed and rigid structures to which the track system 140 may be mounted. Preferably, there are two remote side surfaces 130 with a plane of operation for one retractable wall 110 between them, and with one guide track 150 attached to each of the two remote side surfaces 130, and one flexible insert 160 removably displaced within each guide track 150. However, other embodiments may comprise more than one retractable wall 110 and/or more than two guide tracks 150 and flexible inserts 160.

Figure 2A:
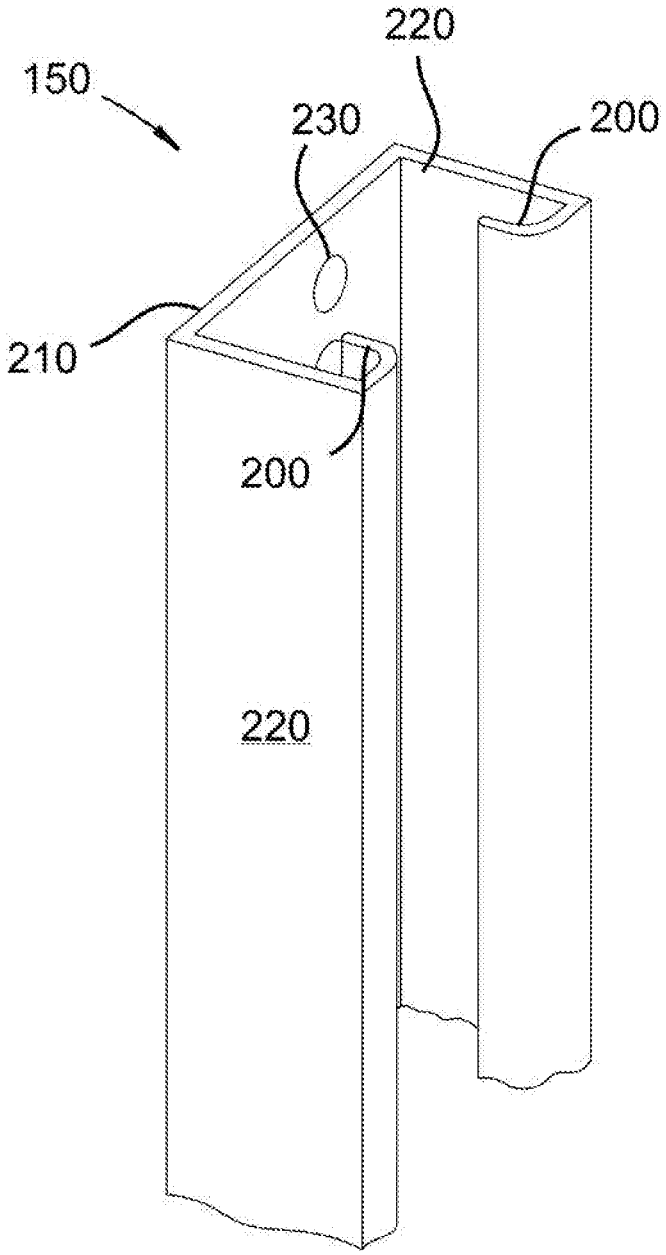
FIG. 2A depicts one embodiment of a guide track.

FIG. 2A depicts one embodiment of a guide track 150. Each guide track 150 comprises reentrant flanges 200. In one embodiment, each guide track 150 comprises two reentrant flanges 200. In one embodiment, the reentrant flanges 200 are shaped in a way so as to engage with side wall flanges on side walls of each flexible insert 160. In one embodiment, the reentrant flanges 200 extend the length of each guide track 150. In one embodiment, each guide track 150 has a rectangular prismatic configuration, with a back 210, two sides 220, and an open front with reentrant flanges 200 curving inward toward the open front. In one embodiment, each guide track 150 is a C-channel. In one embodiment, each guide track 150 comprises perforations 230, preferably on the back 210 of the guide track 150, through which fasteners that mount the guide track 150 to the remote side surfaces 130 pass. Preferably, the perforations 230 are not larger than the heads of the fasteners. In different embodiments, the fasteners may be screws, nails, bolts, or similar devices commonly known in the art. In one embodiment, each guide track 150 comprises a rigid material. In one embodiment, each guide track 150 comprises metal, preferably steel. In one embodiment, each guide track 150 extends the length of the remote side surface 130 to which it is mounted.

Figure 2B:
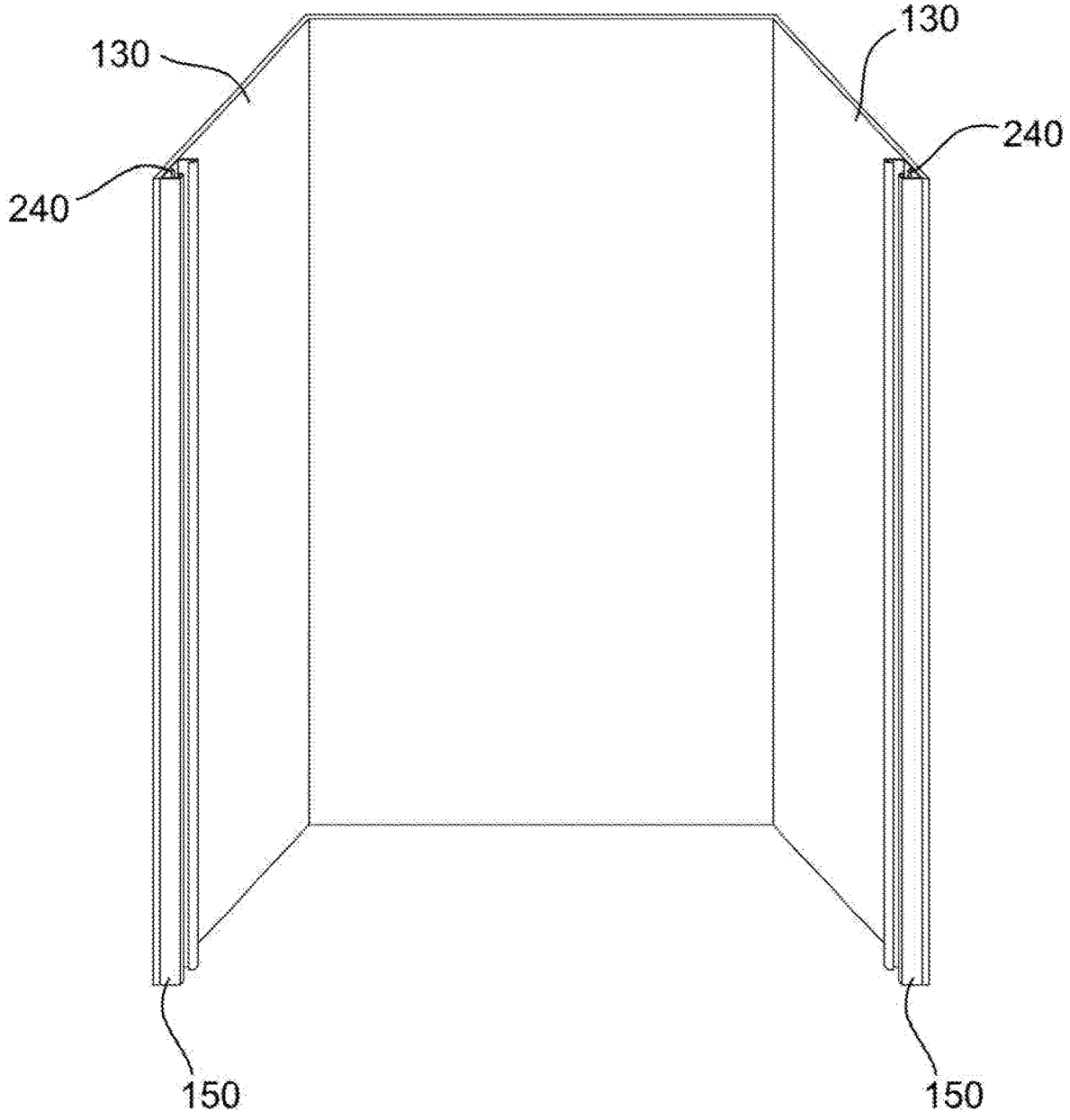
FIG. 2B depicts one embodiment of a plurality of guide tracks mounted to remote side surfaces that define a plane of operation for a retractable wall that moves between open and closed positions.

FIG. 2B depicts one embodiment of a plurality of guide tracks 150 mounted to remote side surfaces 130 that define a plane of operation for a retractable wall 110 that moves between open and closed positions. In one embodiment, the remote side surfaces 130 are walls of a building. In another embodiment, the remote side surfaces 130 are posts or poles. In other embodiments, the remote side surfaces 130 may be other fixed and rigid structures to which the plurality of guide tracks 150 may be mounted. Preferably, there are two remote side surfaces 130 with a plane of operation for one retractable wall 110 between them, and with one guide track 150 attached to each of the two remote side surfaces 130. However, other embodiments may comprise more than two guide tracks 150 and/or more than one retractable wall 110. In one embodiment, each guide track 150 is mounted on a remote side surface 130 in a position exactly parallel to another guide track 150, and in a position where the reentrant flanges 200 and an open front of each guide track 150 are facing outward. In one embodiment, each guide track 150 is mounted to a remote side surface 130 by means of fasteners 240. In one embodiment, each guide track 150 comprises perforations 230, preferably on the back 210 of the guide track 150, through which fasteners 240 that mount the guide track 150 to the remote side surfaces 130 pass. Preferably, the perforations 230 are not larger than the heads of the fasteners 240. In different embodiments, the fasteners 240 may be screws, nails, bolts, or similar devices commonly known in the art. In one embodiment, the fasteners 240 are secured at multiple, evenly spaced positions along the length of the guide track 150. In one embodiment, each guide track 150 extends the length of the remote side surface 130 to which it is mounted.

Figure 3:
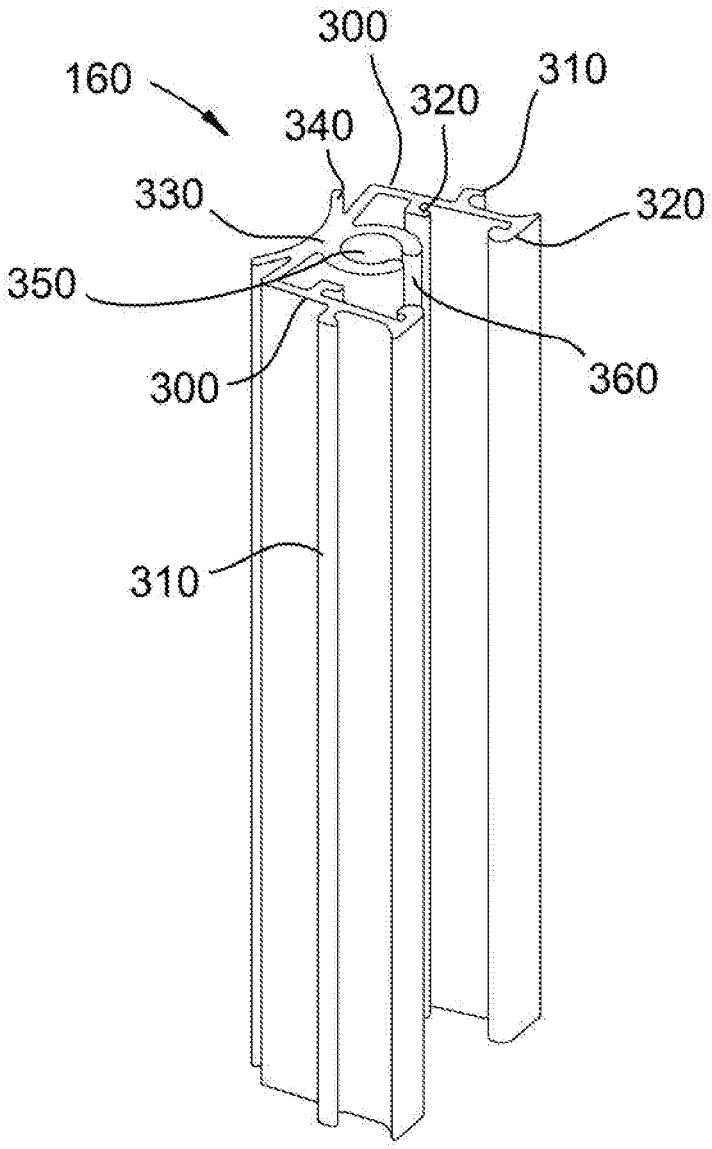
FIG. 3 depicts one embodiment of a flexible insert.

FIG. 3 depicts one embodiment of a flexible insert 160. Each flexible insert 160 is removably displaced within a guide track 150. In one embodiment, each flexible insert 160 extends the entire length of the corresponding guide track 150 in which it is removably displaced. Each flexible insert 160 comprises a flexible material. In one embodiment, each flexible insert 160 comprises plastic. The flexible composition of each flexible insert 160 allows each flexible insert 160 to be manipulated and bent into a position that allows it to be easily slipped or popped into each rigid guide track 150. The flexibility also allows each flexible insert 160 to bend and maneuver slightly with the pull of the retractable wall 110, allowing the retractable wall 110 to flex when force is exerted on the retractable wall 110, without tearing and without breaking the track system 140, while still having the track system 140 held fast in a secure position due to the presence of the rigid track guide 150.

Each flexible insert 160 comprises side walls 300. In one embodiment, each flexible insert 160 comprises two side walls 300. The side walls 300 comprise side wall flanges 310 that engage with the reentrant flanges 200 of the plurality of guide tracks 150 to connect the plurality of flexible inserts 160 to the plurality of guide tracks 150. In one embodiment, the side wall flanges 310 are protrusions that hook at the tips. In one embodiment, the side wall flanges 310 are located on the exterior portion of the side walls 300. In one embodiment, each side wall 300 comprises one side wall flange 310. In one embodiment, each side wall 300 also comprises interior flanges 320, preferably two interior flanges 320 on the interior of each side wall 300. The interior flanges 320 may hold a sealing member 400 in place.

Each flexible insert 160 further comprises a back wall 330. In one embodiment, each flexible insert 160 comprises two side walls 300 and a back wall 330, arranged in a rectangular configuration with an open front side. In one embodiment, the side walls 300 meet the back wall 330 at 90 degree angles. In one embodiment, the back wall 330 is bowed to leave space between the back wall 330 of each flexible insert 160 and the track guide 150 in which the flexible insert 160 is removably displaced, leaving space for the fasteners 240 that are used to mount the track guide 150 to the remote side surfaces 130. In one embodiment, the back wall 330 is bowed at an angle between 5 and 10 degrees, preferably at a 6-degree angle. Because of the space left behind the flexible insert 160 for the fasteners 240, the flexible insert 160 improves the aesthetics of the track system 140, given that the fasteners 240 can be covered up, when they might otherwise be visible in systems without a flexible insert 160. It also improves the security of the retractable wall system 100, given that removing the retractable wall 110 also requires removing the flexible insert 160 in order to get to the fasteners 240 to remove the guide track 150, whereas, with a typical door, the fasteners are exposed on one side of the door and can be easily removed in order to remove the door and gain entrance to an area beyond the door, even when it is locked. In one embodiment, the back wall 330 comprises one or more appendages 340 adjoining the guide track 150 that center the flexible insert 160 within the guide track 150. These appendages 340 allow the back wall 330 to be bowed and yet still touch the guide track 150 in the back, so that the flexible insert 160 will be centered and fit securely and evenly within the guide track 150. In one embodiment, there are two appendages 340 that extend from the middle of the back wall 330 in an arch that protrudes from opposite edges of the back wall 330.

The back wall 330 of each flexible insert 160 comprises a channel 350. In one embodiment, the channel 350 is an annular channel. In other embodiments, the channel 350 has different configurations. Each channel 350 comprises an opening 360. In one embodiment, the opening 360 measures between approximately 0.025 and 0.075 inches across, preferably measuring approximately 0.05 inches. In one embodiment, the opening 360 extends down the entire length of the flexible insert 160. In one embodiment, the opening 360 is parallel to the back wall 330. A side edge of a retractable wall 110 is inserted into the channel 350. In one embodiment, the side edge of the retractable wall 110 comprises a PVC cord, such as a Keder cord. In one embodiment, the side edge of the retractable wall 110 has a diameter that is larger than the opening 360, so that the side edge of the retractable wall 110 will not escape out by the opening 360. In one embodiment, the side edge of the retractable wall 110 has a diameter that is between approximately 3 to 7 times larger than the opening 360. The side edge of the retractable wall 110 engages and travels along the channel 350 as the retractable wall 110 moves between open and closed positions.

In one embodiment, the back wall 330 flexes when a tensile force is exerted on the retractable wall 110. In one embodiment, walls of the channel 350 are thicker than the back wall 330 of the flexible insert 160. In one embodiment, walls of the channel 350 are approximately 1.5 times thicker than the back wall 330. In other embodiments, walls of the channel 350 are up to 3 times thicker than the back wall 330. This is so that the back wall 330 will flex and bend more easily than the walls of the channel 350. Consequently, when force is applied to the retractable wall 110, the back wall 330 will bend, allowing the retractable wall 110 to flex with the force as well, without tearing or breaking anything in the system. The walls of the channel 350, however, will not bend, and therefore will not release the side edge of the retractable wall 110—at least until a point when too much force is applied. When an excessive amount of tensile force is exerted on the retractable wall 110, the walls of the channel 350 will finally bend. Because they bend more easily than the back wall 330 breaks, before the back wall 330 breaks or the retractable wall 110 tears, the walls of the channel 350 will flex open, expanding the size of the opening 360, such that the side edge of the retractable wall 110 will disengage and be released from the channel 350 by means of the opening 360 before any part of the system breaks as a result of the force.

Figure 4A:
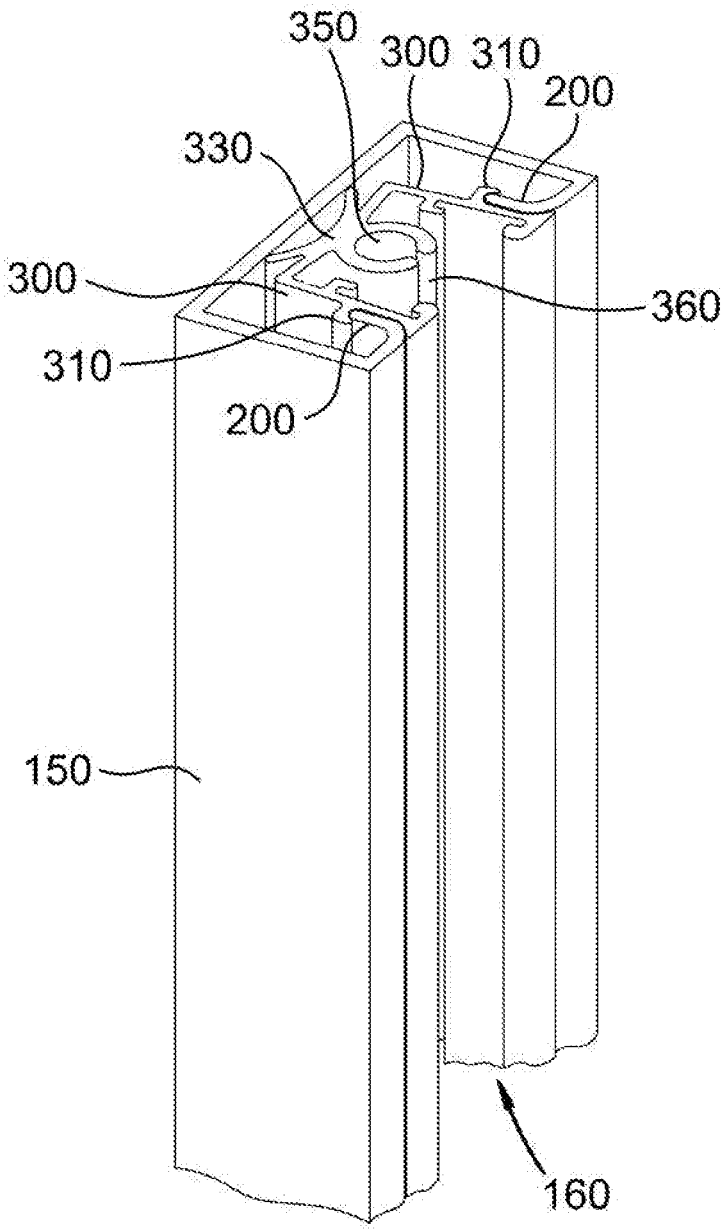
FIG. 4A depicts one embodiment of a flexible insert removably displaced within a guide track.

FIG. 4A depicts one embodiment of a flexible insert 160 removably displaced within a guide track 150. In one embodiment, each flexible insert 160 extends the entire length of each guide track 150. Each flexible insert 160 comprises side walls 300 comprising side wall flanges 310 that engage with the reentrant flanges 200 of the guide track 150 to connect the flexible insert 160 to the guide track 150. In one embodiment, the side wall flanges 310 are protrusions that hook at the tips. In one embodiment, the side wall flanges 310 are located on an exterior portion of the side walls 300. In one embodiment, each side wall 300 comprises one side wall flange 310. In one embodiment, each guide track 150 comprises two reentrant flanges 200. In one embodiment, the reentrant flanges 200 are shaped in a way so as to engage with side wall flanges 310 on the side walls 300 of each flexible insert 160. In one embodiment, each guide track 150 comprises a rigid material, such as metal. In one embodiment, each flexible insert 160 comprises a flexible material, such as plastic. The flexible composition of each flexible insert 160 allows each flexible insert 160 to bend and maneuver slightly with the pull of the retractable wall 110, allowing the retractable wall 110 to flex when force is exerted on the retractable wall 110, without tearing and without breaking the track system 140, while still having the track system 140 held fast in a secure position due to the presence of the rigid track guide 150, which is mounted to a remote side surface 130. The flexible composition of each flexible insert 160 also allows each flexible insert 160 to be manipulated and bent into a position that allows it to be easily popped into each rigid guide track 150 with a minimal amount of pressure, so that assembly is instantaneous and easy. The flexible insert 160 may also be slid into position within the guide track 150 because the flexible insert 160 and the guide track 150 slideably connect by means of the reentrant flanges 200 and the side wall flanges 310. In one embodiment, the back wall 330 of each flexible insert 160 is bowed to leave space between the back wall 330 of each flexible insert 160 and the track guide 150 in which the flexible insert 160 is removably displaced, leaving space for the fasteners 240 that are used to mount the track guide 150 to the remote side surfaces 130. Because of the space left behind the flexible insert 160 for the fasteners 240, the flexible insert 160 improves the aesthetics of the track system 140, given that the fasteners 240 can be covered up, when they might otherwise be visible in systems without a flexible insert 160. It also improves the security of the retractable wall system 100, given that removing the retractable wall 110 also requires removing the flexible insert 160 in order to get to the fasteners 240 to remove the guide track 150, whereas, with a typical door, the fasteners are exposed on one side of the door and can be easily removed in order to remove the door and gain entrance to an area beyond the door, even when it is locked.

Figure 4B:
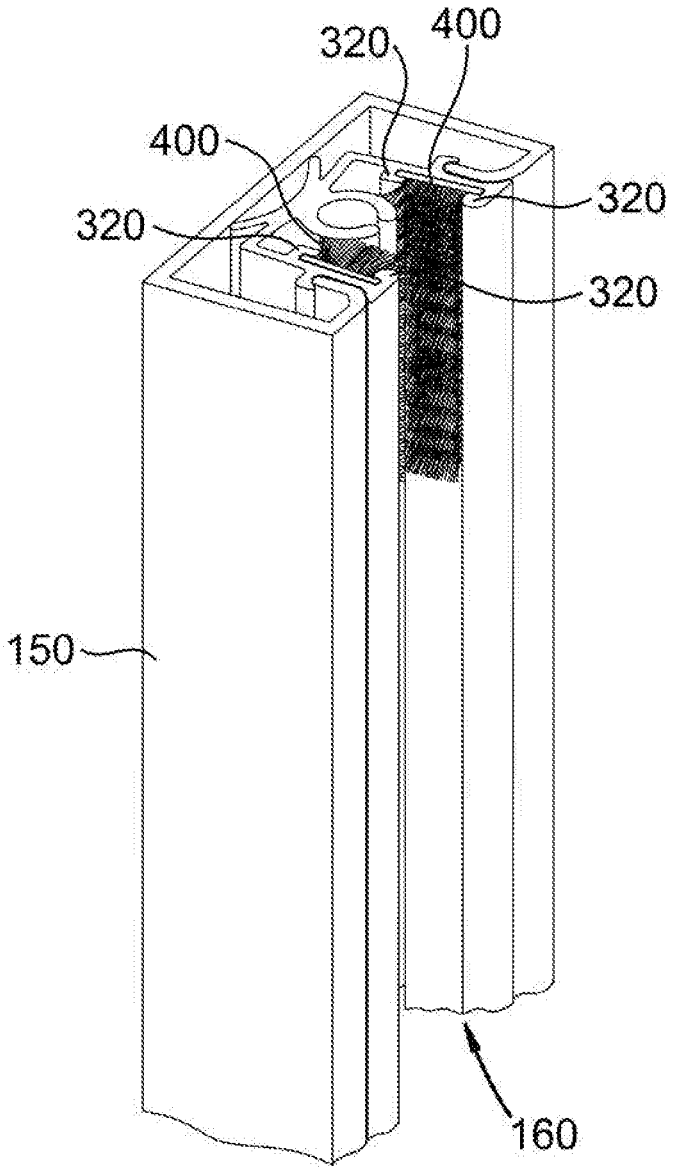
FIG. 4B depicts one embodiment of a flexible insert removably displaced within a guide track and one or more sealing members attached to the flexible insert.

FIG. 4B depicts one embodiment of a flexible insert 160 removably displaced within a guide track 150 and one or more sealing members 400 attached to the flexible insert 160. In one embodiment, the track system 140 comprises one or more sealing members 400. In one embodiment, each side wall 300 of each flexible insert 160 comprises interior flanges 320, preferably two interior flanges 320 on the interior of each side wall 300. The interior flanges 320 may hold one or more sealing members 400 in place. In one embodiment, the one or more sealing members 400 are brushes. In other embodiments, the one or more sealing members 400 comprise fabrics, styrofoams, or plastics. The one or more sealing members 400 seal closed the open spaces within the track system 140, providing improved sound-proofing, protection from debris, and aesthetics. Preferably, the one or more sealing members 400 allow the retractable wall 110 to move up and down between open and closed positions uninhibited, creating minimal friction.

Figure 4C:
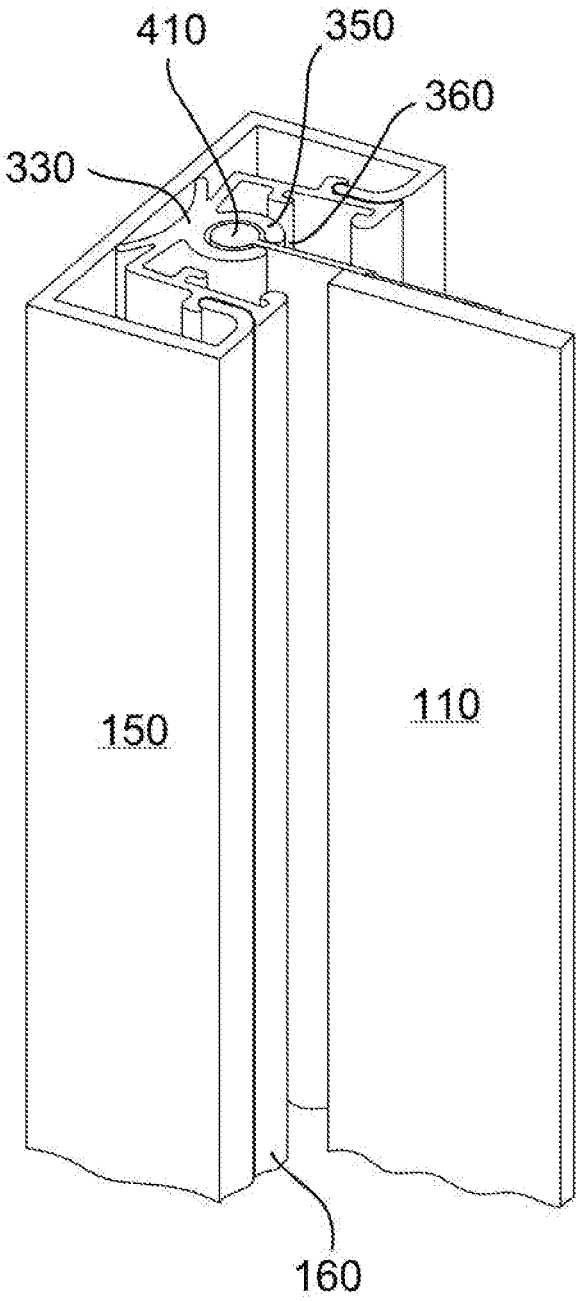
FIG. 4C depicts one embodiment of a flexible insert removably displaced within a guide track, and the flexible insert comprising a back wall comprising a channel comprising an opening, wherein a side edge of a retractable wall is engaging and traveling along the channel between open and closed positions.

FIG. 4C depicts one embodiment of a flexible insert 160 removably displaced within a guide track 150, and the flexible insert 160 comprising a back wall 330 comprising a channel 350 comprising an opening 360, wherein a side edge 410 of a retractable wall 110 is engaging and traveling along the channel 350 between the retractable wall's 110 open and closed positions. In one embodiment, the channel 350 is an annular channel. In other embodiments, the channel 350 has different configurations. In one embodiment, the channel 350 protrudes out from the back wall 330. In one embodiment, the opening 360 of each channel 350 measures between approximately 0.025 and 0.075 inches across, preferably measuring approximately 0.05 inches. In one embodiment, the opening 360 extends down the entire length of the flexible insert 160. In one embodiment, the opening 360 is parallel to the back wall 330 of the flexible insert 160. A side edge 410 of a retractable wall 110 engages the channel 350, which, in one embodiment, is accomplished when the side edge 410 of the retractable wall 110 is inserted into the channel 350 by being slipped into the channel 350 from the top and slid down into the channel 350. The side edge 410 of the retractable wall 110 then moves down or back up, traveling along the channel 350, as the retractable wall 110 moves between open and closed positions. In another embodiment, the side edge 410 of the retractable wall 110 is inserted into the channel 350 by means of the opening 360. In one embodiment, the side edge 410 of the retractable wall 110 engages the channel 350, and the retractable wall 110 extends out from the side edge 410, extending out of the channel 350 through the opening 360. In one embodiment, the side edge 410 of the retractable wall 110 comprises a PVC cord, such as a Keder cord. In another embodiment, the side edge 410 of the retractable wall 110 comprises another of a variety of cylindrical cords, such as those made from wood, plastic, or metal. In another embodiment, the side edge 410 of the retractable wall 110 has a non-cylindrical configuration. In another embodiment, the side edge 410 of the retractable wall 110 comprises a zippered edge. In one embodiment, the side edge 410 of the retractable wall 110 has a diameter that is larger than the opening 360. In one embodiment, the side edge 410 of the retractable wall 110 has a diameter that is between approximately 3 to 7 times larger than the opening 360. This is so that the side edge 410 of the retractable wall 110 will not escape out by the opening 360 except when an excessive amount of tensile force is exerted on the retractable wall 110. In that case, the walls of the channel 350 expand slightly, so that the side edge 410 of the retractable wall 110 disengages from the channel 350 by means of the opening 360.

Figure 5:
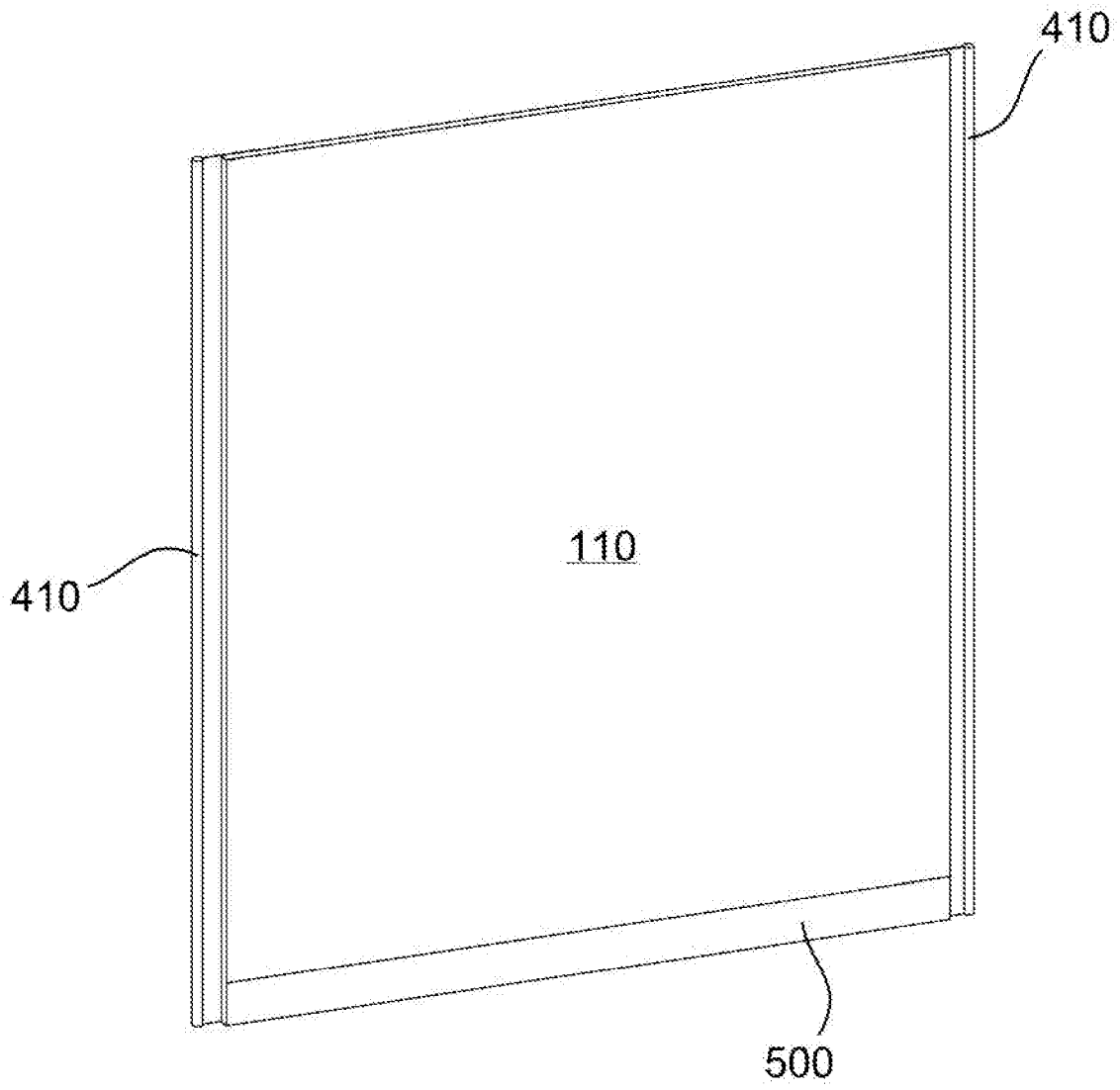
FIG. 5 depicts one embodiment of a retractable wall.

FIG. 5 depicts one embodiment of a retractable wall 110. In one embodiment, the retractable wall 110 comprises a rectangular configuration. In one embodiment, the retractable wall 110 is in the shape and size of the plane of operation defined by the remote side surfaces 130 to which the plurality of guide tracks 150 are mounted. The retractable wall 110 comprises a sheet of material that is flexible enough to be wound around a motorized drum 120. In one embodiment, the retractable wall 110 comprises a curtain. In one embodiment, the retractable wall 110 comprises sound-attenuating material, such as mass-loaded vinyl (MLV). In one embodiment, the side edges 410 of the retractable wall 110 that engage with the channels 350 of the plurality of flexible inserts 160 comprise PVC cords, such as Keder cords. In another embodiment, the side edges 410 of the retractable wall 110 comprise another of a variety of cylindrical cords, such as those made from wood, plastic, or metal. In another embodiment, the side edges 410 of the retractable wall 110 have a non-cylindrical configuration. In another embodiment, the side edges 410 of the retractable wall 110 comprise a zippered edge. In one embodiment, the side edges 410 of the retractable wall 110 have a diameter that is larger than the opening 360 of each channel 350. In one embodiment, the side edges 410 of the retractable wall 110 have a diameter that is between approximately 3 to 7 times larger than each opening 360. In one embodiment, the retractable wall 110 comprises a kick plate 500. In one embodiment, the side edge of the kick plate 500 does not engage the channel 350 of each flexible insert 160, but rather extends to a point tangent to the flexible insert 160. In other embodiments, the side edge of the kick plate 500 is fixed with a connecting piece that allows the side edge of the kick plate 500 to engage with the channel 350.

Figure 6A:
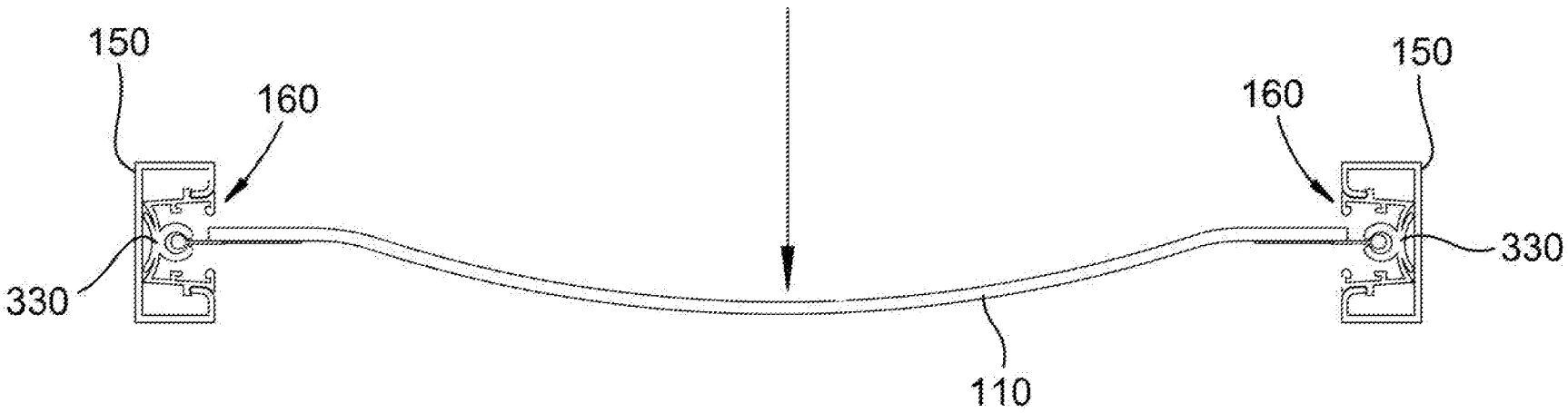
FIG. 6A depicts one embodiment of the back wall of each flexible insert flexing when a tensile force is exerted on the retractable wall.

FIG. 6A depicts one embodiment of the back wall 330 of each flexible insert 160 flexing when a tensile force is exerted on the retractable wall 110. Each flexible insert 160 comprises a flexible material. In one embodiment, each flexible insert 160 comprises plastic. The flexibility allows each flexible insert 160 to bend and maneuver slightly with the pull of the retractable wall 110, allowing the retractable wall 110 to flex when force is exerted on the retractable wall 110, without tearing and without breaking the track system 140, while still having the track system 140 held fast in a secure position due to the presence of the rigid track guide 150.

Figure 6B:
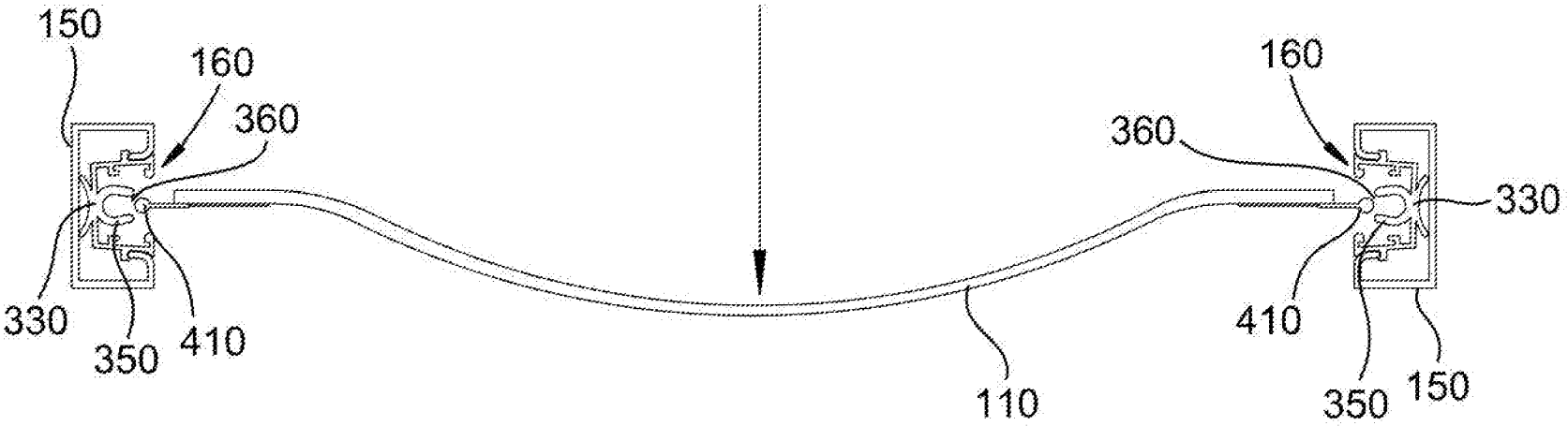
FIG. 6B depicts one embodiment of the side edges of a retractable wall disengaging from the channels of a plurality of flexible inserts by means of the openings in the channels when an excessive amount of tensile force is exerted on the retractable wall.

FIG. 6B depicts one embodiment of the side edges 410 of a retractable wall 110 disengaging from the channels 350 of a plurality of flexible inserts 160 by means of the openings 360 in the channels 350 when an excessive amount of tensile force is exerted on the retractable wall 110. In one embodiment, the back wall 330 of each flexible insert 160 flexes when a tensile force is exerted on the retractable wall 110. In one embodiment, walls of each channel 350 are thicker than each back wall 330 of each flexible insert 160. In one embodiment, walls of each channel 350 are approximately 1.5 times thicker than each back wall 330. In other embodiments, walls of each channel 350 are up to 3 times thicker than each back wall 330. This is so that each back wall 330 will flex and bend more easily than the walls of each channel 350. Consequently, when force is applied to the retractable wall 110, each back wall 330 of each flexible insert 160 will bend, allowing the retractable wall 110 to flex with the force, without tearing or breaking anything in the system. The walls of each channel 350, however, will not bend, and therefore will not release the side edges 410 of the retractable wall 110—until a point when too much force is applied. When an excessive amount of tensile force is exerted on the retractable wall 110, the walls of each channel 350 will finally bend. Because they bend more easily than each back wall 330 breaks, before a back wall 330 breaks or the retractable wall 110 tears, the walls of each channel 350 will flex open, expanding the size of the opening 360 in each channel 350, such that the side edges 410 of the retractable wall 110 will disengage and be released from each channel 350 by means of the opening 360. This will happen before any part of the system breaks as a result of the force.

The invention claimed is:

1. A track system for a retractable wall comprising:

two vertical, opposing, rigid C-channels, each C-channel comprising a C-channel back wall and two C-channel side walls, and wherein each of the C-channel side walls comprises a flange with a flange surface facing the C-channel back wall; and a flexible insert fitted inside each C-channel and extending from a top portion to a bottom portion of each C-channel, each flexible insert formed from a single piece of material and comprising:

an insert back wall wherein the insert back wall comprises one or more appendages extending in an arch from a middle of the insert back wall to center the flexible insert within the C-channel;

two insert side walls extending at ninety degree angles from opposite extremities of the insert back wall, each insert side wall having a protrusion that abuts the flange surface, to immobilize each insert side wall within the C-channel;

a wall edge retention channel comprising channel walls extending from the insert back wall between the two insert side walls, the wall edge retention channel shaped with an opening, the opening sized to retain an enlarged end of the retractable wall when the wall edge retention channel is not flexed; wherein the insert back wall is configured to bend in response to a tensile force from the retractable wall; and wherein the wall retention channel is configured to flex and enlarge the opening sufficient to allow the enlarged end to come out of the wall retention channel, when subject to an excessive tensile force from the retractable wall.

2. The track system of claim 1, wherein the C-channels comprise perforations through which fasteners that mount the C-channels to remote side surfaces pass.

3. The track system of claim 1, wherein the retractable wall comprises a curtain.

4. The track system of claim 1, wherein the retractable wall comprises sound-attenuating material.

5. The track system of claim 2, wherein the remote side surfaces are walls of a building.

6. The track system of claim 1, wherein the flexible inserts comprise plastic.

7. The track system of claim 1, wherein the wall edge retention channel is an annular channel.

8. The track system of claim 1, wherein the opening measures between approximately 0.025 and 0.075 inches.

9. The track system of claim 1, wherein the enlarged edge of the retractable wall comprises a PVC cord.

10. The track system of claim 1, wherein the enlarged edge of the retractable wall has a diameter between approximately 3 to 7 times larger than the opening.

11. The track system of claim 1, wherein the wall edge retention channel walls are thicker than the insert back wall.

12. The track system of claim 1, further comprising one or more seals attached to an interior surface of the insert side walls.

13. The track system of claim 12, wherein the one or more seals are brushes.

14. The track system of claim 1, wherein the retractable wall comprises a kick plate.

* * * * *